US005215435A

United States Patent [19]

Webb et al.

[11] Patent Number: 5,215,435

[45] Date of Patent: Jun. 1, 1993

[54] ANGLED COOLING AIR BYPASS SLOTS IN HONEYCOMB SEALS

[75] Inventors: Alan L. Webb, Cincinnati; Terry T. Eckert, Fairfield, both of Ohio

[73] Assignee: General Electric Company, Cincinnati, Ohio

[21] Appl. No.: 783,462

[22] Filed: Oct. 28, 1991

[51] Int. Cl.[5] ..... F10D 11/00

[52] U.S. Cl. ..... 415/173.7; 415/174.4; 415/115; 277/53; 277/75; 277/192

[58] Field of Search ..... 415/170.1, 173.1, 173.4, 415/173.5, 173.7, 174.4, 174.5, 115, 116; 277/53, 70, 71, 75, 78, 79, 192

[56] References Cited

U.S. PATENT DOCUMENTS 3,365,172 1/1968 McDonough et al. ..... 415/173.4
4,513,975 4/1985 Hauser et al. ..... 277/75
4,554,789 11/1985 Napoli et al. .
4,820,116 4/1989 Houan et al. .
4,820,119 8/1989 Joyce .
4,822,244 4/1989 Maier et al. .
4,869,640 9/1989 Schwarz et al. ..... 415/173.7
5,037,114 8/1991 Gray ..... 415/173.5

FOREIGN PATENT DOCUMENTS 2017228 10/1979 United Kingdom ..... 415/173.1

*Primary Examiner*—Edward K. Look
*Assistant Examiner*—Christopher Verdier
*Attorney, Agent, or Firm*—Jerome C. Squillaro; John R. Rafter

[57] ABSTRACT

A labyrinth seal having a static honeycomb land and a toothed rotary land, an angled passage is formed in the honeycomb land to communicate cooling air from the static vane region of the interstage HP section of the turbine into the aft cavity which is bounded by the rotating stage two blade whereby the exiting cooling air will acquire a velocity component which is in the same direction as the rotating stage two blade.

4 Claims, 2 Drawing Sheets

ANGLED COOLING AIR BYPASS SLOTS IN HONEYCOMB SEALS

FIELD OF THE INVENTION

The present invention relates generally to gas turbine engines, and more particularly, to the cooling of the forward and aft cavities in the interstage region of the turbine.

BACKGROUND OF THE INVENTION

It is well known that turbines are provided to extract energy from the hot gas stream as it impinges on the turbine blades which in turn cause a rotary action of an associated rotary apparatus. The blades are in the form of air foils and manufactured from materials capable of withstanding extreme temperatures. On the other hand, their mounting is designed to withstand high mechanical loads and stresses as against the high temperature requirement of the blades. For this reason, it is important to protect the mounting or shank portions of the blades from the direct impact of the high temperatures of the hot gas stream. Therefore, the blade and vane elements of the turbine are provided with platforms which axially combine to define a boundary for the hot gas stream isolating the mounting shank portions from the hot gas stream.

Such protective attempt is equally important throughout the rotor cavity. However, it becomes more pronounced in the interstage region of the high pressure portion of turbine where the boundary of the expanding hot gases comes close to temperature sensitive areas of the rotor cavity, such as the forward and aft cavities bounded by the disk post for the stage one blade wheel, the platform for the stage two stationary nozzle assembly and by the disc post of the stage two blade wheel.

According to present practice labyrinth-type seals are used between the forward and aft cavities. Such seals are well known in the art and include a plurality of circumferential teeth which are contiguous with a circumferential sealing surface made from a high temperature resistant abradable material or other deformable materials to form the sealing surface with which the labyrinth teeth coact and, due to the deformability of the honeycomb material, the sealing surface becomes deformed without injury to the teeth thereby establishing a minimum clearance required under the operating conditions.

When such labyrinth seal is installed in the high pressure interstage region of the high pressure or HP turbine between the forward and aft cavities as can be seen from the detailed description hereinafter, during operation cooling air passes through the HP stage two nozzle and purges the forward cavity behind the stage one disk. This air then leaks through the labyrinth seal to purge the aft cavity in front of the stage two disk post. With such arrangement, stage two disk creep has been found due to the temperature rise in the cooling air as it passes through the labyrinth seal and, for some operating conditions, inflow of the hot gas stream into the aft cavity due to insufficient purge flow. In order to remedy the above-noted deficiency, axial slots were incorporated into the honeycomb portion of the interstage seal to supply additional cooling air directly to the aft cavity and thus reduce the net aft cavity air temperature. It has been found, however, that the air stream leaving the axial slots requires energy input to be accelerated to the rotor speed, increasing the temperature of the air relative to the stage two rotor. Therefore, the efficiency of such a system remained below expectations.

OBJECTS AND SUMMARY OF THE INVENTION

It is, therefore, an object of the present invention to provide an improved labyrinth seal apparatus for use between adjacent compartments of an apparatus where cooling air entering the static member of the labyrinth seal at a predetermined velocity from a relatively stationary region of the apparatus and exiting through the static member of the seal into a region bounded by a rotating member of the apparatus will be directed to acquire a component of velocity compatible with the velocity of the rotating member.

It is another object of the present invention to provide a labyrinth seal for use in the interstage region of the HP turbine, wherein cooling air coming from the nozzle vanes and entering the static member of the labyrinth seal and exiting into the aft cavity, will be directed at an angle to acquire- a component of velocity compatible with the velocity of the rotating stage two blade wheel.

Accordingly, the present invention provides an improved labyrinth seal for use between adjacent compartments of an apparatus, where cooling air entering the static member of the labyrinth seal at a predetermined velocity from a relatively static region of the apparatus and exiting through the static member of the seal into a region bounded by a rotating member of the apparatus will be directed to acquire a component of velocity compatible with the velocity of the rotating member.

According to another aspect of the present invention, there is provided a labyrinth seal for use in the interstage region of the HP turbine, wherein cooling air coming from the nozzle vanes and entering the static member of the labyrinth seal and exiting into the aft cavity, will be directed at an angle to acquire a component of velocity compatible with the velocity of the rotating stage two blade wheel.

According to still another aspect of the present invention, there is provided a labyrinth seal for use in the interstage region of the HP turbine, wherein cooling air coming from the static nozzle vanes and entering through a plurality of holes formed in the static honeycomb member of the seal into an angled passage formed also in the honeycomb member, will exit the angled passage and directed thereby at an angle to acquire a tangential component of velocity compatible with the velocity of the rotating stage two blade wheel.

BRIEF DESCRIPTION OF THE DRAWINGS

The present invention will become more readily apparent from the following description of a preferred embodiment thereof, shown and illustrated by way of example, and described in reference to the accompanying drawings, in which.

DESCRIPTION OF THE PREFERRED EMBODIMENTS

Figure 1:
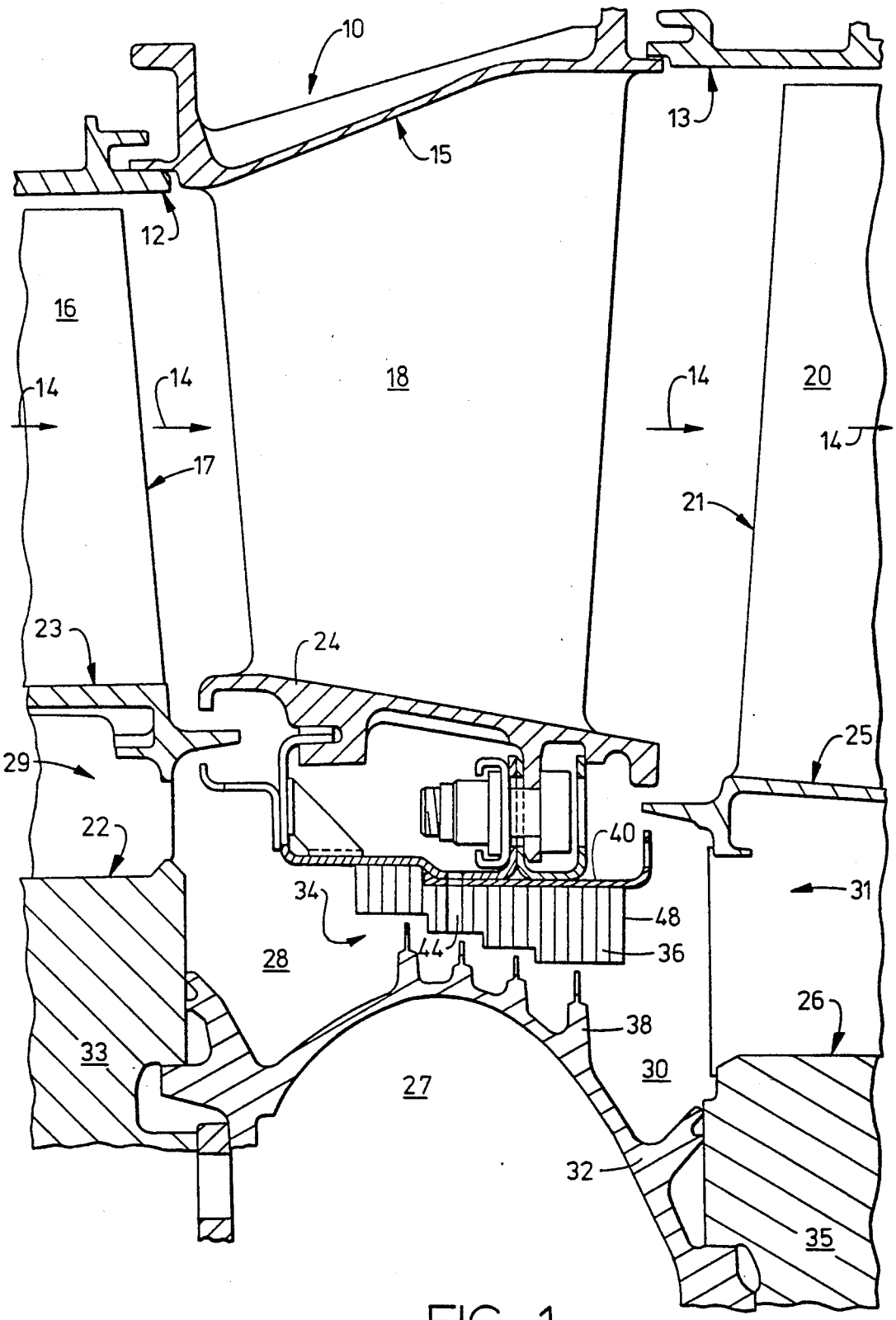
FIG. 1 illustrates in a schematic fashion and in section the flow of cooling air through the interstage labyrinth seal in the HP turbine section incorporating features of the present invention.

With reference to FIG. 1 which depicts in a simplified sectional view the flow of cooling air through an interstage labyrinth seal in a HP section of the turbine, it is seen that the turbine 10 is disposed in a casing immediately downstream of a combustion chamber (not shown) which emits the hot combustion gases into a hot gas passage 14 into impinging contact with the stage one and stage two sections of the high pressure or HP turbine, of which only the stage one turbine rotor 16, the stage two vane stator or nozzle 18 and the stage two turbine rotor 20 are shown. The engine operates in the conventional manner wherein a fuel is burned in the combustion chamber and the products of combustion are guided by the first stage vanes (not shown) through the first turbine rotor 16 and by a second set of vanes 18 through the second turbine rotor 20. The vanes direct the air into an optimized angle of attack for energy transfer to rotor blades 17 and 21, of the first and second turbines 16 and 20 respectively. Energy thus transferred is utilized to drive a shaft (not shown) coupled to the rotor wheels and by which a compressor and a fan upstream of the combustor and various accessories of the engine are operated.

The individual blades 17 of the stage one turbine rotor include a shank and dovetail region for attaching an individual blade 17 to a stage one disk 33 by means of a like number of disk posts 22. Individual platforms 23 disposed between adjacent blade shanks 29 serve to define the inner hot gas passage 14. Similarly the vane or nozzle stator 18 includes vane platforms 24 that also define the gas passage 14. The cooperating blade shank and dovetail region 31 of the stage two rotor likewise attach to a disk post 26 and include individual platforms 25 which also help define the gas passage 14. The inner turbine platforms 23 and 25 and the inner stator platform 24 together with turbine shrouds 12 and 13 and stator vane outer platforms 15 define the hot gas passage 14.

The rotating structure of the turbine including the first and second turbine rotor blade disks 33 and 35 respectively with their respective disc posts 22 and 26 and their respective blade shank mountings and blade shaft members (not shown) lie within a rotor cavity which is disposed in the radial interior of the hot gas passage 14. The requirements for stress tolerance to the mechanical forces imposed upon the disc posts and other rotating elements disposed within the rotor cavity prevent the utilization of materials having extreme thermal resistance. Hence, it becomes necessary to substantially isolate the rotor cavity from the temperatures of the hot gas passage and to provide for special cooling measures, to avoid a decrease of the performance efficiency.

The present invention is directed to solve the above noted cooling problems associated with the interstage section of the HP part of the turbine and, more particularly, of the forward cavity 28 formed behind the stage one disk post 22 and by one side of a labyrinth seal 34 and of the aft cavity 30 formed in front of the stage two disk post 26 and by the other side of the labyrinth seal 34, which is bounded on its radially inward side from the rotor cavity 27 by a thermal shield 32.

The general structure of labyrinth seals is well known in the art and known to include a honeycomb outer sealing member arranged annularly within a support member in a single strip, or otherwise and cooperates with a central member having a plurality of teeth thereon and may be arranged in a stepped fashion and mounted to be contiguous with the abradable honeycomb member to provide the sealing function. Either the honeycomb or the toothed member can be the static or rotating member, depending on the particular application. Both sealing members are made from high temperature resistant special metals or alloys.

Figure 2A:
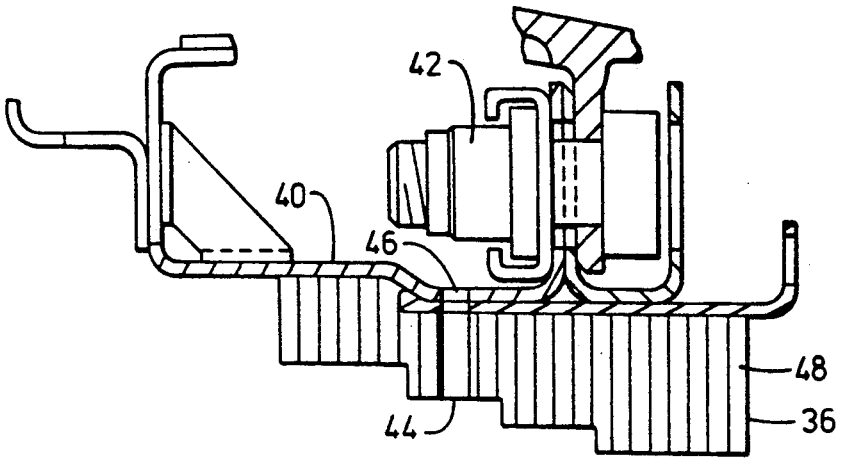
FIG. 2*a* illustrates in a sectional view taken along line 2*a*—2*a* in FIG. 2*b* the static honeycomb section of the interstage labyrinth seal incorporating the present invention, showing additionally the fixing of the static honeycomb section to supporting turbine parts.
Figure 2B:
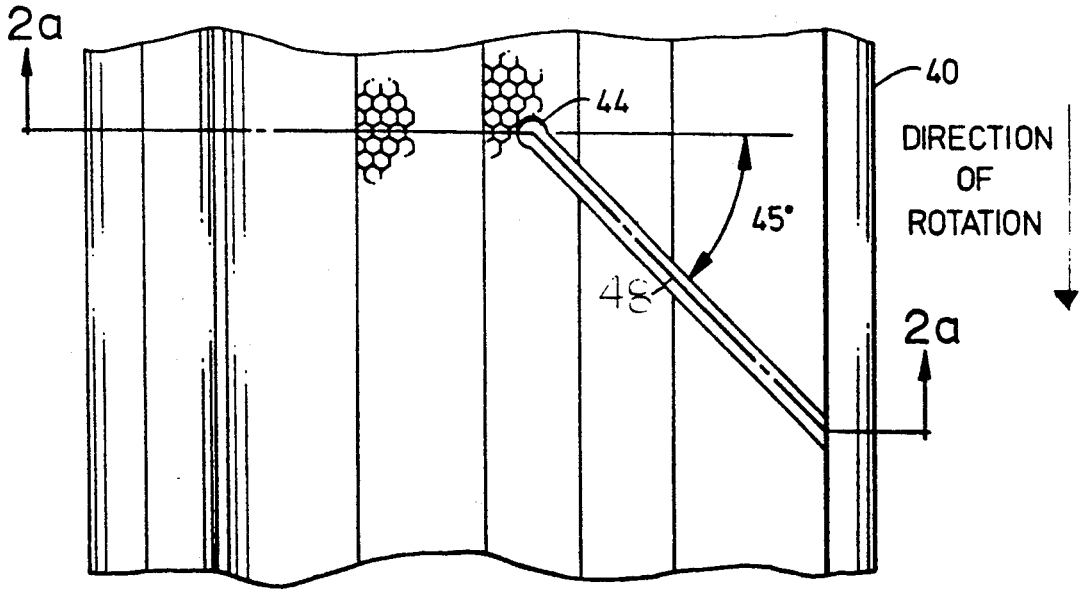
FIG. 2*b* illustrates in a top view the static seal portion of FIG. 2*a*.

In the particular application herein, the honeycomb member 36 is the static member and is made from a strip material the final necessary peripheral length of which is cut into six 60° segments which are then brazed or otherwise attached to a backing ring 40 which may also be segmented, to form the annular seal land. Prior to brazing the honeycomb segments to the backing ring segments 40, a plurality of vertical passages 44 and a plurality of angled slots 48 are formed in the honeycomb material as can be seen in FIGS. 2*a* and 2*b*. The vertical passages 44 communicate with the plenum above the backing ring 40 through holes 46 made in the backing ring 40. The angled slots 48 are formed to pass through the entire height of the honeycomb material. Preferably, four slots 48 are made in each 60° segment and are directed at angle of about 45° with respect to the axial direction, and consequently, at an angle of about 45° with respect to the axis of rotation of turbine rotors 16 and 20. After forming the vertical passages 44 and the angled slots 48, the honeycomb segments are brazed or otherwise attached to the backing ring segments 40 which in turn are bolted, as illustrated at 42, to one or more second stage vane platforms 24 which may also be segmented to allow for thermal expansion, as it is well known in the art. The honeycomb member 36 may be arranged in a stepped fashion which will cooperate with similarly arranged teeth of the rotary seal member 38 of the thermal shield 32.

When assembled, the vertical passage 44 will line up and communicate with one of the cavities formed between the teeth of the rotary seal member, preferably with the cavity formed between the first upstream pair of teeth. The angled slot 48 will direct the air flowing therethrough into the aft cavity 30 and imparts to it an angular velocity. Such exiting airstream further interacts with the rotor through friction to accelerate it to rotor speed. Therefore, less energy is required to accelerate the air from slot 48 to rotor speed than if the slot would be directed axially, which in turn improves the overall efficiency and reliability of the engine. Additionally, the air temperature relative to rotor 35 is reduced below that which an axial slot could accomplish due to the reduced energy required to accelerate the cooling flow to rotor speed. Such reduced air temperature results in a cooler stage two disk post 26 and, consequently, an increase in the creep life capability of the stage two disk post 26. It is also noted that the angular slot will assume a curved or arcuate form when mounted into the backing ring 40 since in the formation stage the strip was laid out flat, while in the mounted form a straight slot will assume the arcuate form. It is also noted that the slot 48 is made in the flat honeycomb strip by grinding, electro-discharge machining or similar means.

While there has been described herein what is considered to be a preferred embodiment of the present invention, other modifications of the invention shall be apparent to those skilled in the art from the teaching herein and, it is, therefore, desired to be secured in the appended claims all such modifications as fall within the true spirit and scope of the invention.

Accordingly, what is desired to be secured by letters patent of the United States is the invention as defined and differentiated in the appended claims.

What is claimed is:

1. A labyrinth seal for use in an apparatus wherein cooling air is communicated between a relatively static region of the apparatus and a region bounded by a rotating member of the apparatus, said labyrinth seal comprising a static seal member and a rotary toothed member arranged in sealing relationship with each other, the improvement comprising passage means formed in said static seal member and directed at an angle with respect to an axis of rotation of said rotating member such that the cooling air exiting into said region bounded by said rotating member will acquire a tangential component of velocity in the direction of rotation of said rotating member, said passage means including an inlet and an outlet, said outlet being axially aft of said inlet and adjacent said region bounded by said rotating member, wherein said passage means causes an increase in a creep life capability of said rotating member.

2. A labyrinth seal apparatus for use in the high pressure interstage region of a gas turbine apparatus wherein cooing air is communicated between a relatively static region of the turbine and a region bounded by a rotating member of said turbine, said labyrinth seal apparatus comprising a static seal member and a rotary toothed member arranged in sealing relationship with respect to each other, passage means formed in said static seal member and directed at an angle with respect to an axis of rotation of said rotating member such that the cooling air entering said region bounded by said rotating member will acquire a tangential velocity component in the direction of rotation of said rotating member, said passage means including an inlet and an outlet, said outlet being axially aft of said inlet and adjacent said region bounded by said rotating member, wherein said passage means causes an increase in a creep life capability of said rotating member.

3. A labyrinth seal apparatus for use in the high pressure interstate region of a gas turbine apparatus wherein cooling air is communicated between a relatively static region of the turbine and a region bounded by a rotating member of said turbine, said labyrinth seal apparatus comprising a static seal member and a rotary toothed member arranged in sealing relationship with respect to each other, passage means formed in said static seal member and directed at an angle with respect to an axis of rotation of said rotating member such that the cooling air entering said region bounded by said rotating member will acquire a tangential velocity component in the direction of rotation of said rotating member, wherein said static seal member is a honeycomb member, and wherein said passage is formed at an angle of about 45° with respect to the axial direction of said rotating member.

4. A labyrinth seal apparatus for use in the high pressure interstage region of a gas turbine apparatus wherein cooling air is communicated between a relatively static region of the turbine and a region bounded by a rotating member of said turbine, said labyrinth seal apparatus comprising a static seal member and a rotary toothed member arranged in sealing relationship with respect to each other, passage means formed in said static seal member and directed at an angle with respect to an axis of rotation of said rotating member such that the cooling air entering said region bounded by said rotating member will acquire a tangential velocity component in the direction of rotation of said rotating member, wherein said static seal member is a honeycomb member, wherein said honeycomb member is fixed to a backing support member, aperture means formed in said backing support member for communicating said passage with said relatively static region of the turbine, and wherein said backing support member comprises an annular backing ring comprising a plurality of said apertures, and wherein said honeycomb member is segmented into six segments each having an arcuate length of 60° and each segment comprising four of said passages.

* * * * *